United States Patent [19]

Parks

[11] 4,196,373

[45] Apr. 1, 1980

[54] ELECTRON OPTICS APPARATUS

[75] Inventor: Harold G. Parks, Scotia, N.Y.

[73] Assignee: General Electric Company, Schenectady, N.Y.

[21] Appl. No.: 894,757

[22] Filed: Apr. 10, 1978

[51] Int. Cl.[2] ..... H01J 29/46; H01J 29/56

[52] U.S. Cl. ..... 315/14; 315/391; 313/429

[58] Field of Search ..... 315/391, 14, 374, 376; 313/426, 427, 429, 432; 365/118

[56] References Cited

U.S. PATENT DOCUMENTS

| | | | |
|---|---|---|---|
| 2,850,657 | 9/1958 | McNaney | 313/427 X |
| 3,534,219 | 10/1970 | Newberry | 315/391 |
| 3,641,510 | 2/1972 | Chen | 365/118 |
| 3,936,693 | 2/1976 | Parks et al. | 313/427 |

*Primary Examiner*—Theodore M. Blum

*Attorney, Agent, or Firm*—Geoffrey H. Krauss; James C. Davis; Marvin Snyder

[57] ABSTRACT

Electron optics apparatus, for use in electron-beam lithography, electron-beam-addressable memory tubes and the like, utilizes a tri-potential collimating condenser lens and a multi-element matrix lens of the "flys eye" type with coarse deflection elements positioned therebetween to deflect the collimated electron beam from the condenser lens to the appropriate aperture in the matrix of lenslets. The condenser lens electrode and matrix lens electrode closest to one another, as well as the coarse deflection electrodes therebetween, are substantially the only elements in the apparatus which float at a relatively high electrical potential, thereby simplifying the requirements of peripheral circuitry while retaining the advantages of the "flys eye" matrix lens.

15 Claims, 4 Drawing Figures

14
14a
Ø
68
Z
102
90c
102
$L_{CT}$
$S_y$
66a
66b
Z
100
100a
$D_A$
71a
71
S
70a
D
70
60
90b
95

90
20
46
40
44
42
$S_C$
$S_C$
$D_C$
$L_L$
$T_C$
$L_L$
$V_1$
$V_2$
$V_3$
$Z_{MO}$
111
110
TO OBJECT APERTURE 123
122
124
129
126
128
120
121
$10^{-5}$
$10^{-6}$
$10^{-7}$
$10^{-8}$
BEAM CURRENT—AMPERES
2 3 4 5 6 7 8 9 10
SPOT SIZE MICRONS

ELECTRON OPTICS APPARATUS

BACKGROUND OF THE INVENTION

The present invention relates to electron optics and, more particularly, to novel electron optics apparatus in which a relatively large number of electrodes are maintained at D.C. ground potential.

Electron optics apparatus capable of moving a finely focussed electron beam along a predetermined path upon a target, or of stopping at a predetermined point thereon, is utilized in electron-beam lithography and electron-beam-addressable memories. Typically, an electron "gun" comprising an electron emission source (cathode), an anode and a beam-forming electrode are utilized to emit a stream of electrons towards the target. Various other electrodes are interposed between the electron "gun" and the target to focus the beam to the required diameter at the target surface and to deflect the beam over the required pattern, or to the desired position, upon the target surface. Typically, many of the plurality of focus and deflection electrodes require drive potentials different from the potentials utilized by others of the electrodes, whereby various elements of the electron optics apparatus must be floated at high voltage, both with respect to ground and with respect to adjacent elements. The necessity for floating the driving electronics at high voltage is undesirable both for reasons of apparatus reliability and personal safety. It is, therefore, desirable to implement electron optics apparatus having a relatively large number, and percentage, of the necessary electrodes therefor at ground potential and, particularly, having the target, upon which the deflected and focussed electrode beam impinges, maintained at D.C. ground potential.

BRIEF SUMMARY OF THE INVENTION

In accordance with the invention, electron optics apparatus utilizes an electron gun, comprised of a cathode, beam-forming plate and anode, along with blanking and spray electrodes, to emit a slightly diverging beam of electrons; a tri-potential collimating condenser lens operates on the beam of electrons prior to coarse deflection of the collimated beam to address a desired one of a plurality of lenslets formed in an electron matrix lens. The collimated electron beam is focussed to a relatively small spot diameter upon the target surface by action of the matrix lens. Fine deflection elements are positioned between the electronic matrix lens and the target for sweeping, or positioning, the focussed electron beam within an area upon the target surface associated with the particular matrix lenslet to which the beam is coarsely deflected. The target, as well as at least one element of the condenser lens and the matrix lens, in addition to the beam-forming plate, anode and spray electrodes of the electron gun, are all maintained at ground D.C. potential.

In one preferred embodiment, a two-plate electronic matrix lens is utilized with an orthogonal grid of paralleled fine deflection bars. The first-encountered plate of the matrix lens is maintained at the same potential as the nearest electrode of the condenser lens, while the remaining matrix lens plate and the condenser lens electrode furthest therefrom are maintained at ground potential. In this manner, all high frequency electronics, except for the coarse deflection means interposed between the condenser and matrix lenses, is maintained at ground D.C. potential, while the beam is both collimated in the region immediately prior to the coarse deflection electrodes and variations in coarse deflection voltage have substantially zero first order effect on the beam. The tri-potential collimating lens is of the decelerating type and provides a potential barrier to stray electrons entering the region thereof, to prevent the stray electrons from reaching the matrix lens and deteriorating the focus of the beam impinged upon the target surface; the electron gun operates at a relatively higher voltage and with relatively greater efficiency, to further increase the advantages gained from the configuration of my novel electron optics apparatus.

Accordingly, it is an object of the present invention to provide novel electron optics apparatus having a relatively large number of electrodes therein operated at D.C. ground potential.

This and other objects of the present invention will become apparent upon consideration of the following detailed description, when taken in conjunction with the accompanying drawings.

DETAILED DESCRIPTION OF THE INVENTION

Figure 1:
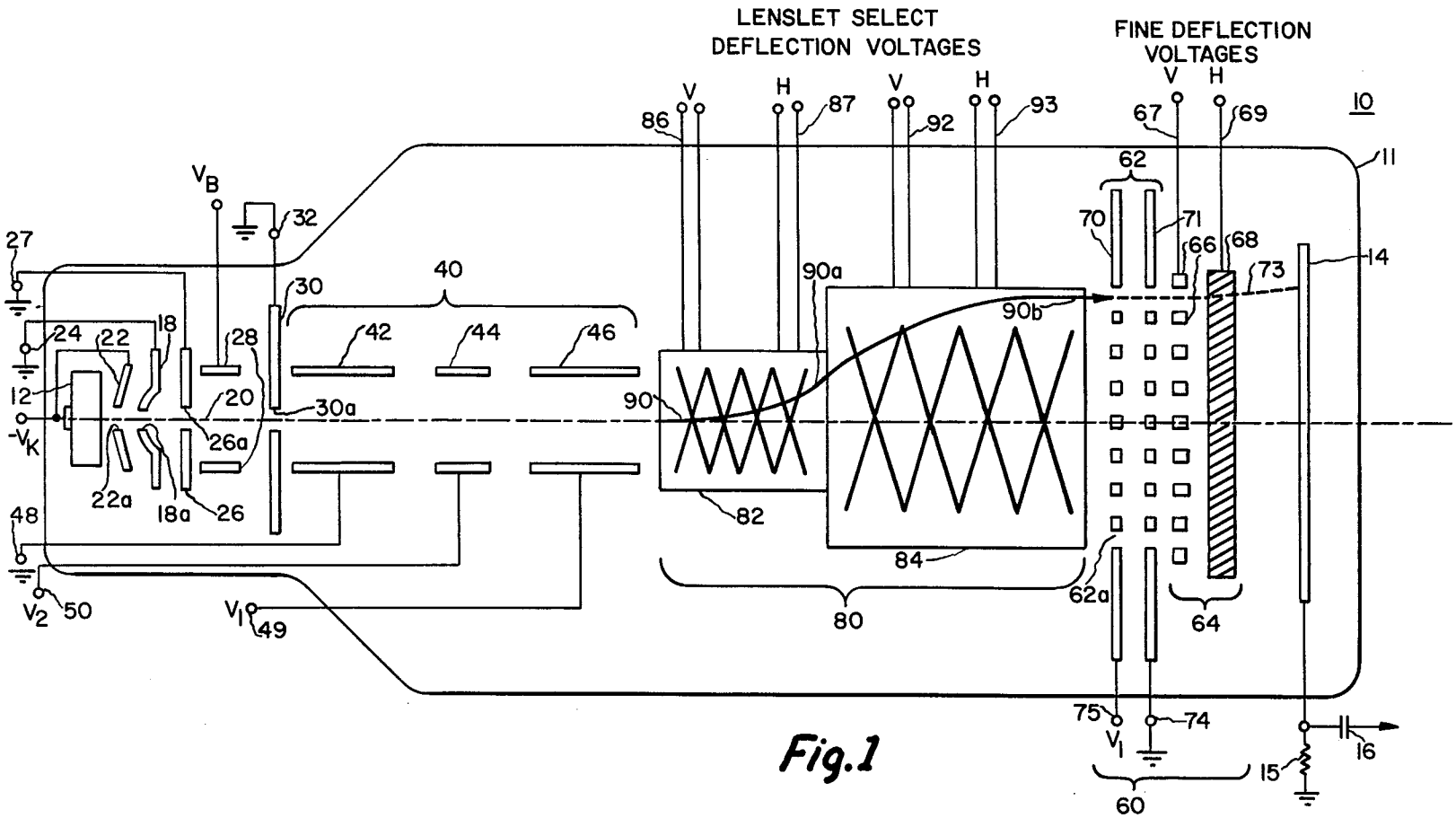
FIG. 1 is a schematic, sectionalized side view of an electron-beam-addressing memory tube utilizing one embodiment of the novel electron optics apparatus of the present invention.

Referring initially to FIG. 1, a preferred embodiment of my electron optics apparatus is utilized in an electron-beam-addressed memory tube 10. Within the evacuated envelope 11 of the tube, an electron-emitting source, such as a cathode 12, and a target 14 are positioned at opposite ends thereof. Target 14 may advantageously be of the metal-oxide-semiconductor sandwich type described and claimed in U.S. Pat. No. 3,761,895, entitled "Method and Apparatus for Storing and Reading Out Charge in An Insulating Layer", issued Sept. 25, 1973 to the assignee of the present invention and incorporated herein by reference. Target 14 has information stored at selected ones of a two-dimensional array of sites thereon, by impingement of an electron beam thereat, while the target is subjected to various potential biases between the layers thereof, as more fully described in the aforementioned patent, and stores this information as electric charge until erased; the information can be read from the target by again scanning the electron beam across a sequence of data sites, with biasing potentials of different magnitude and/or polarity (which potential biasing sources, and the circuitry coupling the sources and the target, are not shown for purposes of simplicity). The recovered signal from target 14 appears across a load resistance 15 and is coupled, via a coupling capacitor 16, to external amplification and processing circuitry (also not shown for purposes of simplicity). For purposes of interfacing the signal from target 14 of the circuitry, it is desirable that the target be at, or relatively close to, ground potential.

The electron beam to be scanned across the surface of target 14 is developed from the electrons emitted by cathode 12, energized to a negative potential, $-V_K$. The emitted electrons are attracted to an anode electrode 18, having a central aperture 18*a*, with the aperture and anode axes lying along a central axis 20 of tube 10. A beam-forming plate or plates 22 are utilized, intermediate cathode 12 and anode 18, to provide a beam-forming aperture 22*a* of diameter $d_s$ and having its axis lying along central tube axis 20. Advantageously, the anode 18 is coupled to electrical ground potential, as at tube connection pin 24. An object electrode 26 is positioned transverse to the direction of electron-beam travel and has an aperture 26*a* formed centrally therethrough and along tube axis 20; the object electrode is also advantageously connected to ground potential, as at external connection pin 27. A set of blanking electrodes 28 are positioned about tube axis 20 and coupled to a source of blanking potential $V_B$; if the blanking potential is maintained at substantially ground potential, blanking electrodes 28 have substantially no effect upon the electron beam traveling along central axis 20; if a blanking potential of non-zero magnitude (either polarity) is impressed upon electrode 28, an electric field is formed orthogonal to axis 20 and the electron beam is diverted from a central aperture 30*a* formed in a spray electrode 30. The spray electrode aperture, of diameter greater than the diameter $d_s$ of aperture 26*a*, has its axis also positioned along tube central axis 20 and allows the beam to pass only if blanking electrode 28 is not energized with a blanking potential; energization of the blanking electrode with a blanking potential diverts the electron beam from the aperture onto the conductive, solid material of electrode 30 for conduction to ground, coupled to electrode 30 at tube connection point 32. Thus, a narrow, but somewhat diverging, beam of electrons is emitted through aperture 30*a* in the direction of target 14. The electron beam, in the unblanked condition, passes along central axis 20 through a three-element collimating condenser lens 40. Lens 40 comprises annular first, second and third electrodes 42, 44 and 46, respectively. In accordance with the desire to realize the object that as many of the electron optics apparatus elements be maintained at ground potential, at least for D.C. voltages, the initially-encountered annular condenser lens electrode 42 is coupled to ground potential at tube interconnection pin 48. The exit condenser electrode 46 is coupled to a first potential of voltage magnitude $V_1$ at pin 49 and the middle condenser lens electrode 44 is coupled to another potential of voltage magnitude $V_2$ at pin 50. Thus, as explained more fully hereinbelow, the electron beam exiting from condenser lens electrode 46 is a collimated beam traveling along the central tube axis 20.

A so-called "flys eye" matrix lens 60 is positioned in front of target 14. The matrix lens includes a multi-element lens 62 having a two-dimensional array of lenslet apertures 62*a* therethrough. The electron beam is caused to pass through a selected lenslet and is subsequently finely deflected over a limited area of target 14. By deflecting the axial electron beam, exiting from tri-potential collimating lens 40, to a desired lenslet of the array, essentially all of the information-storing area of target 14 can be addressed. A particular storage site within the area accessible to a particular lenslet, is addressed by means of a fine deflection selector 64. In one preferred embodiment, fine deflection selector 64 consists of a first set of horizontally parallel, spaced-apart electrodes 66 arrayed in the vertical plane and having the spaces therethrough aligned with the lenslet apertures of lens 62, for achieving vertical fine deflection in accordance with the magnitude of at least one (differential) vertical fine deflection potential impressed thereon via external connection pins 67. A second set of parallel, spaced-apart fine deflection bars 68 are vertically disposed parallel to the plane of the first set of electrodes and with the spaces therebetween also aligned with the lenslet apertures. Suitable (differential) horizontal fine deflection potentials are impressed thereon, via external connection pins 69, to accomplish horizontal fine deflection of the focussed beam.

As the overall electron optics system is of the demagnifying type, matrix lens 62 is somewhat critical in performance. In my preferred embodiment, a two-aperture immersion lens, as more fully described and claimed in U.S. Pat. Nos. 3,919,588 (issued Nov. 11, 1975) and 3,936,693 (issued Feb. 3, 1976) both assigned to the assignee of the present invention and incorporated hereby by reference, is utilized. The immersion lens consists of a pair of apertured plates 70 and 71, respectively, having their apertures in alignment to form lens apertures 62*a* and having the planes thereof essentially parallel to one another and essentially perpendicular to axis 20. Each of the plurality of aligned apertures acts to focus a collimated electron beam entering one of the apertures in plate 70 to a fine spot, on the order of a few microns in diameter, upon the surface of target 14, after fine deflection by fine deflection means 64. The deflected electron beam, shown by broken line 73, is focussed upon the target, if the potential between lens plates 70 and 71 is held at a fixed value, commensurate with the spacing distance therebetween and other factors explained more fully hereinbelow. Accordingly, one electrode, e.g. plate 71, of the lens is maintained at ground potential, as at connection pin 74, while the remaining electrode, e.g. the apertured plate 70 first encountered by the electron beam, is maintained at a potential $V_1$, as at external connection pin 75. Thus, the entire "flys eye" matrix lens assembly 60, similar to that described and claimed in U.S. Pat. No. 3,534,219, issued Oct. 13, 1970, for a "Cascaded Electron Optical System", assigned to the assignee of the present invention and incorporated herein by reference, allows a focussed electron beam to be swept across the surface of target 14 and to be positioned at any data site thereon, if the on-axis collimated electron beam exiting from tri-potential collimating condenser lens 40 is directed to the associated lenslet (aligned apertures through electrodes 70 and 71) and through the array of fine deflector electrodes 66 and 68).

A "coarse" deflection means 80, for selecting the proper one of the plurality of lenslets, is positioned between the exiting end of condenser lens 40 and the matrix lens plate 70 furthest from target 14. In my preferred embodiment, lenslet selector means 80 comprises a pair of deflectrons 82 and 84, respectively. The deflectrons, while shown in schematic form indicative of a side view of cylindrical deflectrons, may be rectangular, conical or the like shaped deflectrons. The initially-encountered deflectron 82 receives both vertical and horizontal deflection voltages, which deflection voltages include a D.C. potential, equal to the high voltage potential $V_1$ connected to exiting collimator lens electrode 46 and initially-encountered lens electrode 70. In response to the instantaneous magnitude of the vertical and horizontal deflection voltages, coupled to first deflectron 82 from external connection means 86 and 87, respectively, the electron beam 90 entering the volume of deflectron 82 is deflected away from central system axis 20. It should be understood that while FIG. 1 shows a vertical deflection only, the illustrated deflection is limited by the two-dimensional character of the accompanying drawings and that simultaneously vertical and horizontal deflections of an electron beam 90 are easily achieved. The deflected electron beam 90*a* exits the first deflectron at some angle, determined by the magnitude of the deflection voltages, with respect to central axis 20, and enters the volume of second deflectron 84. A second set of vertical and horizontal "coarse" deflection voltages, at external connection means 92 and 93, respectively, are coupled to the deflection electrodes of second deflectron 84; the magnitude of the horizontal and vertical deflection voltages to second deflectron 84, in addition to being floated at potential $V_1$, are chosen to deflect electron beam 90*a* in the vertical and/or horizontal directions so that the electron beam 90*b* emerging from second deflectron 84 is not only parallel to central axis 20, but is essentially aligned with the center of the desired lenslet of the two-aperture matrix lens 62 and the "fine" deflection apparatus 64 thereafter.

This electron optics apparatus advantageously allows a substantial portion of the high frequency electronics, except for the high frequency deflection circuitry (not shown) utilized for the "coarse" deflection, or lenslet select, voltages, to be maintained at D.C. ground potential. Further, as the electron beam is collimated prior to coarse deflection, variations in coarse deflection voltages have essentially a zero first-order effect on the beam; the tri-potential collimating condenser lens 40 is a decelerating lens whereby stray electrons generated at previous electrode apertures, such as spray aperture 30*a*, encounter a potential barrier and are essentially prevented from reaching matrix lens assembly 60. In a typical memory tube using my preferred embodiment, the potential $V_1$ upon the exit electrode 46 of collimating lens 40 and upon the initially-encountered matrix lens plate 70 is on the order of $-6$ kilovolts, with respect to ground, while the cathode potential $V_K$ is on the order of $-10$ kilovolts with respect to ground, whereby the electron optics apparatus functions as a relatively high voltage to realize a relative high efficiency.

Figure 2:
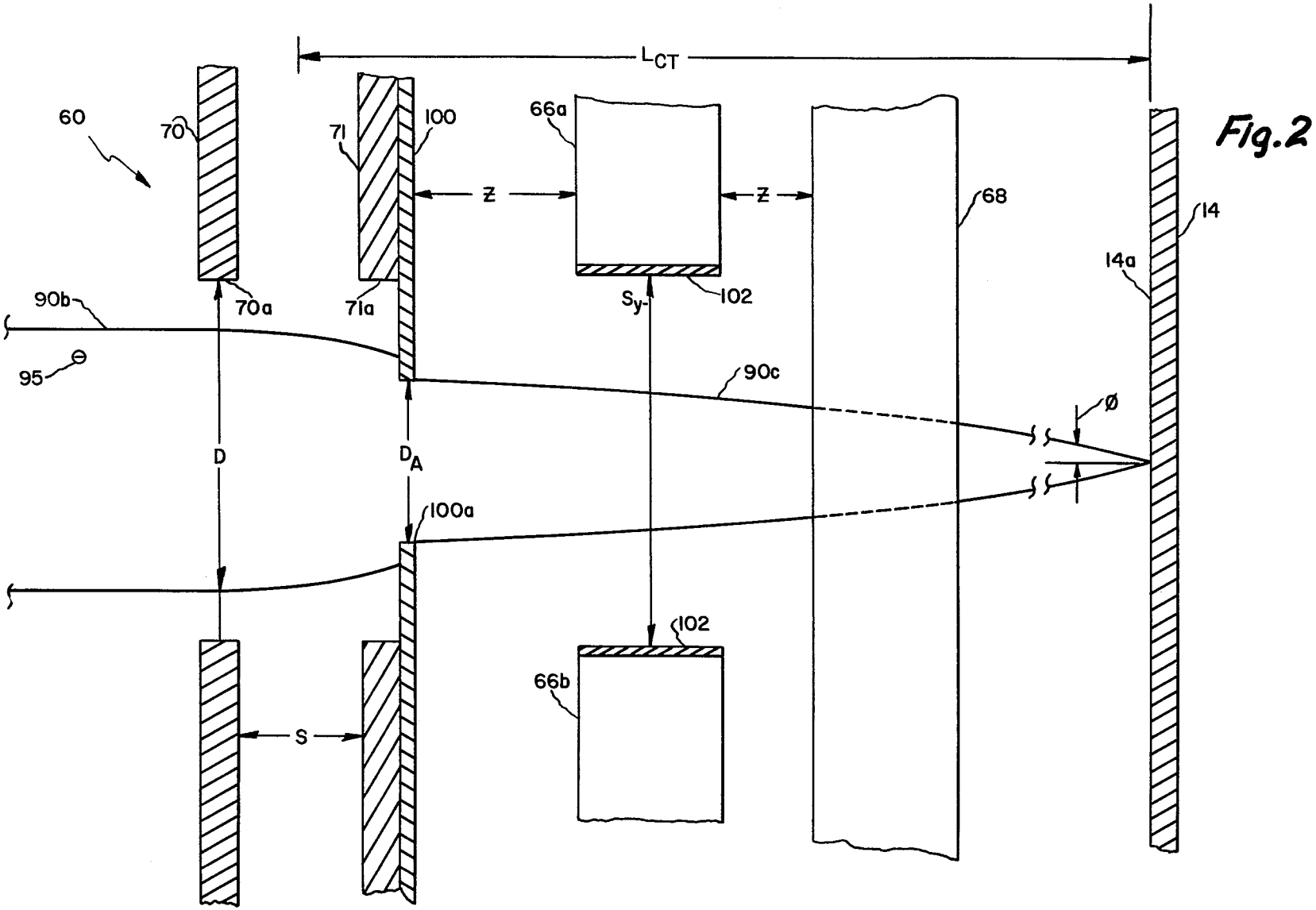
FIG. 2 is a schematic, sectionalized side view of one lenslet of the electronic matrix lens, fine deflection electrodes and target of the memory tube of FIG. 1.
Figure 3:
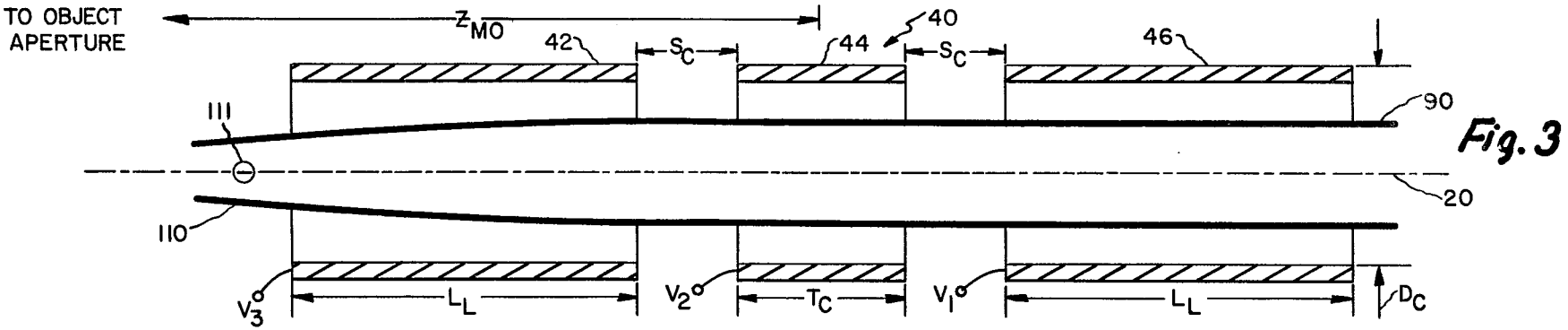
FIG. 3 is a schematic, sectionalized side view of a tri-potential collimating condenser lens, as utilized in the memory tube of FIG. 1.
Figure 4:
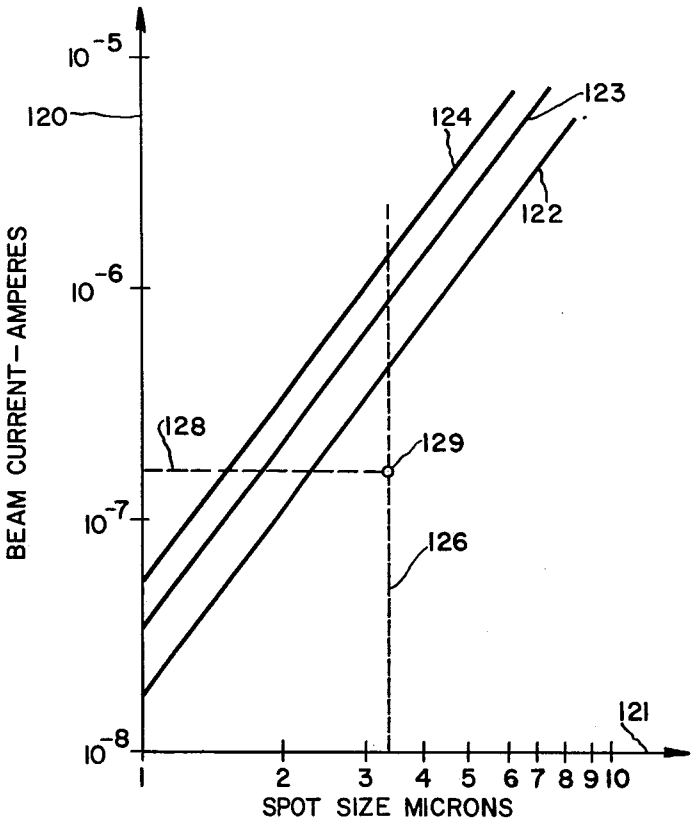
FIG. 4 is a graph illustrating the relationship between beam current and spot size in a typical memory tube utilizing the electron optics apparatus of the present invention.

These advantages, as well as additional details of operation of my novel electron optics apparatus, will become apparent from consideration of FIGS. 2, 3 and 4 and the following analysis. For purposes of analysis, the finely deflected electron beam 90*c* will be focussed to a spot size upon the storage surface 14*a* of the target, commensurate with storing a bit of information at a data site of about 4 microns diameter. It should be understood that the electron beam may be focussed to accommodate other beam spot sizes on the surface of the target, in accordance with the particular usage to which my novel electron optics apparatus is to be employed. The collimated beam 90*b* of electrons 95 enters an aperture 70*a*, of diameter D, of initially-encountered lens electrode 70 and passes therethrough toward the aperture 71*a*, of the same diameter D as the aperture 70*a*, in second lens plate 71. A spacing of distance S exists between the essentially parallel, facing interior surfaces of electrodes 70 and 71. Attached to second lens electrode 71, and maintained at the same essentially ground potential thereof, is a spray electrode 100 having an aperture 100*a* therein, centered along the center of the electron beam and of diameter $D_A$, for reducing the diameter of the electron beam being focussed. Typically, for a 4 micron bit spacing, the matrix lens aperture diameters D are on the order of 30 milli-inches, with the spray aperture diameter $D_A$ being on the order of 9.8 milli-inches, for a lens electrode spacing S on the order of 60 milli-inches. The action of the two-plate matrix lens is such that the reduced-diameter electron beam is converged, as beam 90*c*, to be focussed essentially upon the target surface 14*a*. The beam 90*c* passes through the aligned slots formed between the parallel vertical deflection bars 66*a* and 66*b* and the horizontal deflection bars 68 associated with each lenslet. Advantageously, the deflection bars are formed of an insulative material, such as a ceramic and the like, and have conductive electrodes 102 fabricated upon their facing surfaces to facilitate generation of the necessary electrostatic deflection fields. The distance Z between facing surfaces of the exiting-electrode 100 of the matrix lens and the vertical deflection bars 66*a* and 66*b*, and between the vertical deflection bars and the horizontal deflection bars 68, is established to be on the order of 20 milli-inches, with the separation distance $S_y$ between facing surfaces of deflection electrodes 102 (and a similar distance $S_x$, into and out of the plane of the drawing and therefore not shown for purposes of simplicity, between the electrodes on facing surfaces of the horizontal deflection bar 68) is established on the order of 20 milli-inches. The entire "flys eye" matrix lens 60 is positioned such that the mid-lens distance $L_{ct}$, between target surface 14*a* and a plane parallel to and midway between the facing surfaces of matrix lens electrodes 70 and 71, is on the order of 600 milli-inches.

For the desired mid-focal length $L_{ct}$, of 600 milli-inches, I have determined that, for collimated operation, a normalized focal length ratio (2f/D) is about 49.7, and a normalized spherical abberation constant (2Cs/D) is about $1.1\times10^4$, with a lens accelerating ratio (V) of about 2.28. The beam half-angle $\phi$ at the target is determined by the diameter $D_A$ of aperture 100*a* in spray electrode 100.

The principal aberration effect determining the optics performance is the spherical aberration of the matrix lens. The maximum beam current I in a beam, at target surface 14*a*, with a spot diameter d and a given beam brightness $\beta_i$, and with a lenslet spherical aberration constant $C_s$ is given by:

$$I=(k_1d)^{8/3}(\beta_i/C_s)^{\frac{2}{3}}$$

with an optimum beam half-angle ($\phi_o$) at the target of:

$$\phi_o=(k_2d/C_s)^{\frac{1}{3}}$$

and a beam diameter of geometric spot size (dg) of:

$$dg=k_3C_s\phi_o^3,$$

where the constants $k_1$, $k_2$ and $k_3$ are dependent upon the percentage of total beam current found in the spot at target suface 14*a*. For a spot having about 90% of the total beam current therein, the values of the constants are approximately $k_1=1.3$, $k_2=0.9$ and $k_3=0.96$. The maximum theoretical brightness $\beta_T$, at the image, is given in terms of the Langmuir limit, in units of amperes per square centimeter per steradian, by:

$$\beta_T = j_0(11{,}600/\pi T)V_L$$

where $j_0$ is the cathode loading in amperes per square centimeter, T is the cathode temperature in °K. and $V_L$ is the landing potential, in volts, at the target. As practical electron "guns" do not produce this theoretical brightness value, the actual beam brightness $\beta_i$ is given by:

$$\beta_i = \gamma\beta_T,$$

where $\gamma$ is the electron "gun" efficiency, which for high brightness sources, as utilized herein, is about 80% (with high voltages in the range of 6–10 kilovolts). Thus, in my preferred embodiment, the electron optics apparatus has a landing potential of about 10 kilovolts (the cathode-target potential) and the various parameters of the electron "gun", are summarized in Table I, for various practical values of cathode loading ($j_0$).

Table I

| $j_0$(amp/cm$^2$) | T(°K) | $\beta_i$(amp/cm$^2$/str) |
|---|---|---|
| 1 | 1273 | $2.98 \cdot V_L\gamma$ |
| 2 | 1323 | $3.58 \cdot V_L\gamma$ |
| 3 | 1353 | $8.2 \cdot V_L\gamma$ |

The spot diameter d for maximum current is given by:

$$d = (2C_s/D)(D/2)\phi_o^3(1/k_2) = 3.27 \text{ microns.}$$

The geometric spot size (dg) is given by:

$$dg = k_3C_s\phi_o^3 = k_3K_2d = 2.82 \text{ microns.}$$

The required optical magnification M, assuming that a source aperture of 20 microns is utilized, is given by:

$$M = dg/ds = 0.14.$$

Referring to FIG. 3, the tri-potential condenser lens used in the electron optics apparatus, as described hereinabove, has a first cylindrical electrode 42 into the bore of which the beam 110 of electrons 111 enters from the object aperture 26*a* (of FIG. 1) of the electron source. Electrode 42 has a length $L_L$ and is at a potential $V_3$ (D.C. ground potential, as hereinabove explained). The mid-condenser electrode 44 is also of cylindrical shape, having a length $T_c$ and spaced by a separation distance $S_c$ from the adjacent end plane of first-encountered condenser lens electrode 42; a potential of magnitude $V_2$ is coupled to mid-condenser electrode 44. The condenser exit electrode 46 is also a cylindrical electrode having the same length $L_L$ as the initially-encountered electrode 42 and having its entrance plane situated the condenser spacing distance $S_c$ from the exit plane of mid-condenser electrode 44. Each of the three condenser electrodes 42, 44 and 46, respectively, have a bore diameter $D_c$ substantially equal to one another. As previously explained hereinabove, exit electrode 46 has impressed thereon an electrical potential of magnitude $V_1$, being essentially the high voltage applied to the initially-encountered lens electrode 70 of the matrix lens. The potentials on each of the three condenser lens electrodes are different from one another:

$$V_1 \neq V_2 \neq V_3.$$

The magnitude $V_1$ of the potential on exit electrode 46 is established by the accelerating factor V previously found for the matrix lens, i.e. V=2.28. The matrix lens acceleration factor is also given by:

$$V = (V_3 - V_k)/(V_1 - V_k)$$

For a four micron diameter data site, with the cathode potential Vk set at about −10 kilovolts and the anode and initially-encountered condenser lens electrode 42 at ground potential ($V_3$=0 volts) the potential $V_1$ in the coarse deflection region, and more particularly upon exit electrode 46, is found to be about −5.614 kilovolts.

The slightly divergent electron beam 110 entering the condenser lens is converged therein to exit the condenser lens as a collimated beam 90 lying on the central tube axis 20. Collimation is achieved by establishing the voltage at the mid-condenser electrode 44, in accordance with the function:

$$V_c = (V_2 - V_k)/(V_3 - V_k),$$

where $V_3$ is hereinabove given as zero volts and $V_c$ is a function of the electron-optics apparatus parameters and particularly of the normalized spherical aberration constant and the magnification requirements of the matrix lens. Choosing a value of $V_c$ of about 0.45, and an object aperture diameter $d_s$ of about 24.1 microns, a potential $V_2$ on the central electrode 44 of about −5.5 kv, is obtained. The geometric center of condenser lens 40 is established at a distance $Z_{MO}$ from the object aperture (the object electrode aperture 26*a*) of about 5.49 inches.

The above-described embodiment of my electron optics apparatus provides a spot having an aberration disk of diameter substantially equal to 0.019 microns, which, when compared to a source size of about 24.1 microns, illustrates that the aberrations introduced by the condenser lens are essentially negligible. Thus, the condenser lens essentially collimates the beam and the final image position at the target surface 14*a* is dependent only upon the angle, with respect to central axis 20, at which the collimated beam enters the selected lenslet, for focussing and subsequent fine deflection. The coarse deflection deflectrons are so proportioned to preserve this angle relatively independently of the actual deflection voltages, whereby small variations in the "coarse" deflection drive voltages will have substantially no effect on the final beam position at the target.

Referring now to FIG. 4, the cathode loading requirements for the electron optics apparatus are considered; FIG. 4 graphically illustrates the relationship between the required beam current, plotted along ordinate 120, for a given spot size, plotted along abscissa 121, for different values of cathode loading ($j_0$). The cathode loading curves 122, 123 and 124, respectively, correspond to cathode loadings of 1, 2 and 3 amperes per square centimeter, respectively. For the above-described example, wherein a 4 micron data site is selected, the required beam spot size, of about 3.27 microns, is indicated by vertical broken line 126. Broken horizontal line 128 indicates the beam current (in amperes) required for a beam-addressable-memory tube utilizing 4 micron diameter data sites; the desired operating point 129 is thus well within a cathode loading of 1 ampere per square centimeter with an 80% efficient electron "gun", due to the high efficiency of the matrix lens 60 when operating with the collimated input beam provided by the tri-potential condenser lens 40. Thus, an electron "gun" of somewhat less than 80% efficiency and a cathode loading of somewhat less than 1 ampere per square centimeter (as achieved with aging, element misalignment and the like effects) still allows the desired 4 micron data site operation to be achieved with all of the aforementioned advantages: all high frequency drive electronics, except for the drive electronics to the "coarse" deflection electrodes, can be operated at ground D.C. potential; the beam is collimated in the "coarse" deflection region whereby variations in coarse deflection voltage have substantially zero first order effect on the beam; the collimating lens is initially decelerating whereby secondary electrons generated by the object aperture, prior to the condenser lens, will not reach either the matrix lens or the target; the condenser lens has negligible aberration effects and allows the full electron-optical advantages of the two-aperture matrix lens to be realized; the electron gun operates at a higher voltage to achieve relatively high electron "gun" efficiency; and, with the collimated input beam, the matrix lens may be optimized for a significant reduction in cathode loading whereby increased cathode life is possible.

While one preferred embodiment of the present invention is described with particularity herein, many variations and modifications will now become apparent to those skilled in the art. It is, therefore, my intent that limitation not be by way of the sole presented embodiment, but only in accordance with the appending claims.

What is claimed is:

1. Electron optics apparatus comprising:

source means for emitting a beam of electrons along an apparatus axis;

a target spaced from said source means along said axis and having a surface generally facing said source means;

blanking means disposed along said axis for selectively blanking said electron beam emitted towards said target by said source means;

multi-electrode means disposed along said axis between said source and blanking means and said target for collimating the electron beam emitted toward said target from said blanking means;

multi-electrode lens means situated along said axis between said collimating means and said target and having a two-dimensional array of apertures therethrough for focussing upon said target surface an electron beam passing through any of said apertures;

means positioned along said axis for coarsely deflecting the electron beam from said collimating means to a selected one of said array of lens apertures; and means positioned between said lens means and said target surface for finely deflecting the focused electron beam from any of said lens apertures to a specific point within an area of the target surface associated with that lens aperture through which the beam passes;

said target, said finely deflecting means and at least one electrode of each of said source, collimating and lens means being operated at a D.C. component of the potential thereon substantially equal to ground potential; and said coarsely deflection means and at least one element of each of said collimating and lens means being operated at a D.C. component of the potential thereon different from ground potential.

2. Electron optics apparatus as set forth in claim 1, wherein said collimating means comprises three electrodes sequentially arranged along said axis, each electrode having a potential thereon differing from the potentials on the remaining two electrodes.

3. Electron optics apparatus as set forth in claim 2, wherein each of said electrodes is a cylindrical member having the axis thereof aligned along said apparatus axis.

4. The electron optics apparatus as set forth in claim 2, wherein the electrode of said collimating means nearest to said source means is maintained substantially at ground potential.

5. Electron optics apparatus as set forth in claim 2, wherein the middle electrode of said collimating means is maintained at an electrical potential more negative than the electrical potential at the collimating means electrode furthest from said source means.

6. Electron optics apparatus as set forth in claim 2, wherein said lens means comprises a pair of planar electrodes arranged substantially parallel to one another and essentially transverse to said apparatus axis, each of said lens electrodes having an electrical potential thereon differing from the electrical potential on the remaining lens electrode.

7. Electron optics apparatus as set forth in claim 6, wherein the electrical potential on the lens electrode closest to said target is ground potential.

8. Electron optics apparatus as set forth in claim 6, wherein the electrical potential on the lens electrode closest to said source means is substantially equal to the electrical potential on the collimating means electrode furthest from said source means.

9. Electron optics apparatus as set forth in claim 1, wherein said lens means comprises first and second planar electrodes positioned parallel to one another and essentially transverse to said apparatus axis, each of said lens electrodes having said array of apertures therethrough in alignment with the array of apertures through the other lens electrode each of said lens electrodes having an electrical potential thereon differing from the electrical potential on the other lens electrode.

10. Electron optics apparatus as set forth in claim 9, wherein the electrical potential on the lens electrode closest to said target is equal to ground potential.

11. Electronic optics apparatus as set forth in claim 9, wherein the electrical potential on the lens electrode nearest to said source means is maintained at a value less than the potential on the remaining lens electrode.

12. Electron optics apparatus as set forth in claim 1, wherein said coarse deflection means comprises first and second deflection electrodes sequentially arranged along said apparatus axis.

13. Electron optics apparatus as set forth in claim 12, wherein each of said first and second deflection electrodes comprises a deflectron.

14. Electron optics apparatus as set forth in claim 12, wherein each of said first and second deflection electrodes are operated at a potential having a D.C. component substantially equal to the non-zero potential on an element of each of said collimating means and said lens means closest to said coarse deflection electrodes.

15. Electron optics apparatus as set forth in claim 1, wherein said finely deflecting means comprises first and second pluralities of parallel deflection bars, said first plurality of deflection bars being arranged parallel to one another and orthogonal to the apparatus axis, and the parallel-disposed deflection bars of the second plurality being arranged orthogonal to the apparatus axis and to the first plurality of deflection bars.

* * * * *